United States Patent [19]

Shannon

[11] 4,179,171

[45] Dec. 18, 1979

[54] ELECTRICAL CONNECTOR

[76] Inventor: Shelly L. Shannon, 20 Timothy La., Battle Creek, Mich. 49017

[21] Appl. No.: 883,166

[22] Filed: Mar. 3, 1978

[51] Int. Cl.[2] ..... H01R 13/54

[52] U.S. Cl. ..... 339/17 LC; 339/75 M; 339/91 R; 339/255 R

[58] Field of Search ..... 339/17 L, 17 LC, 17 M, 339/75 M, 75 MP, 91 R, 193 P, 255 R

[56] References Cited

U.S. PATENT DOCUMENTS

| | | | |
|---|---|---|---|
| 2,413,410 | 12/1946 | Hansen et al. | 339/91 R |
| 3,437,984 | 4/1969 | Yorgensen | 339/255 R |
| 3,631,300 | 12/1971 | Humble | 339/17 CF |
| 4,076,361 | 2/1978 | Campbell | 339/75 M |

FOREIGN PATENT DOCUMENTS

| | | | |
|---|---|---|---|
| 664019 | 5/1964 | Italy | 339/255 B |
| 2024563 | 7/1973 | Fed. Rep. of Germany | 339/255 R |

*Primary Examiner*—Gerald A. Dost

*Attorney, Agent, or Firm*—Barnes, Kisselle, Raisch & Choate

[57] ABSTRACT

An electrical connector adapted to be mated with a terminal block of the type having a plurality of terminal contact blades upstanding therefrom. The connector comprises a rigid body of insulating material having a plurality of apertures in each of which a contact slug is suspended by a coil spring for spring-biased electrical contact with a contact blade received in the aperture. A spring end tine projects through and is soldered to conductive zones on a printed circuit board carried by the connector body for electrical connection of the individual contact blades with electronic circuitry. A pair of clamps are pivotally mounted on opposite side edges of the connector body and coupled to a rotatable elliptical cam for selective movement between a retracted position and a position for embracing a terminal block.

12 Claims, 9 Drawing Figures

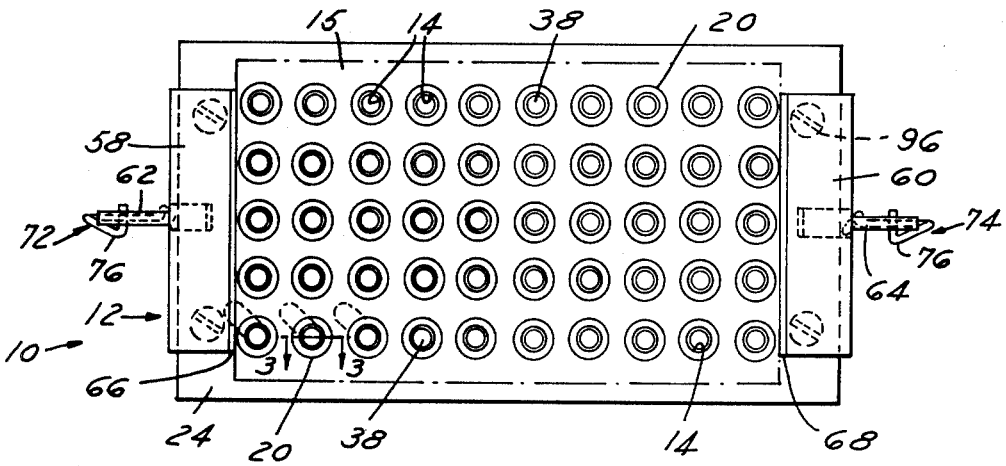

FIG. 7
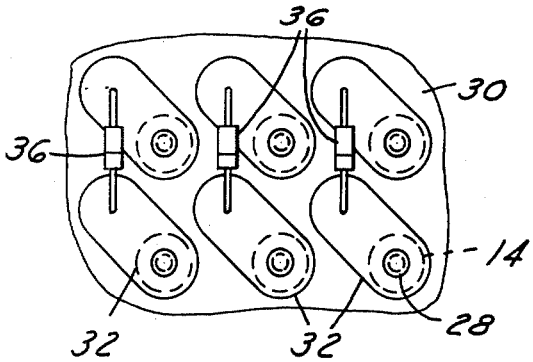
FIG. 9
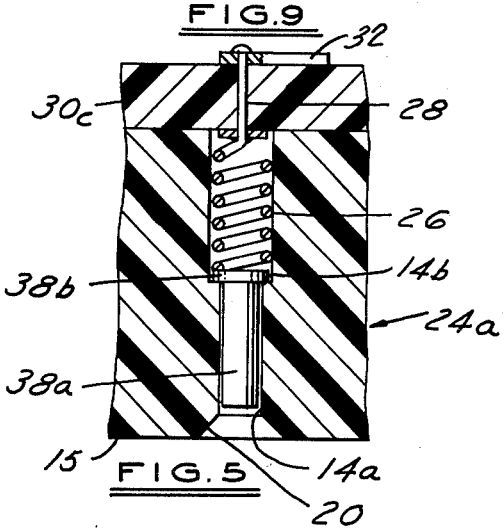
FIG. 5
FIG. 6
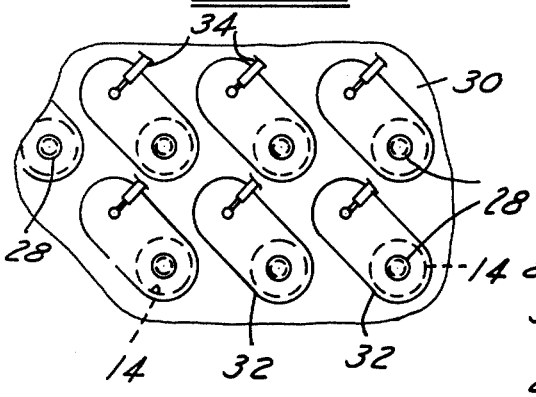
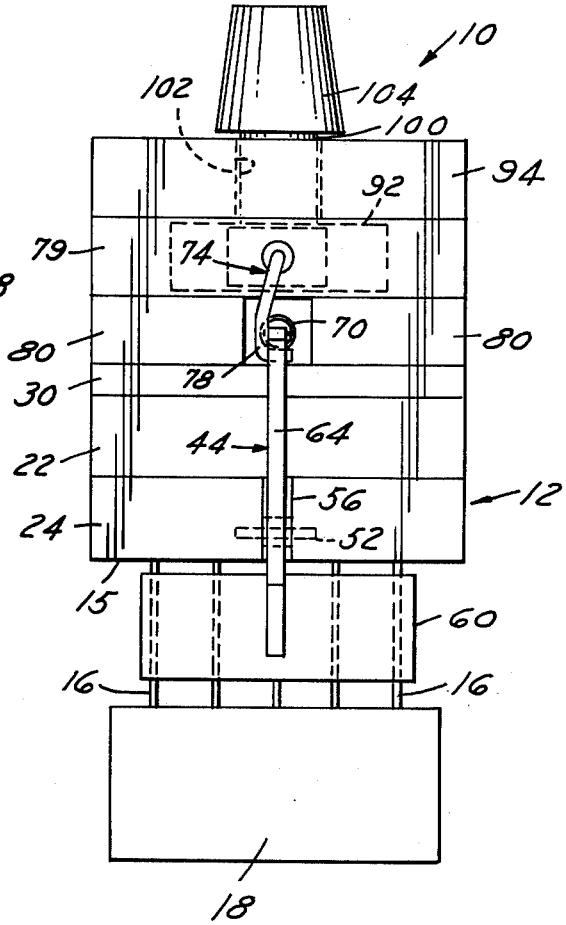
FIG. 8
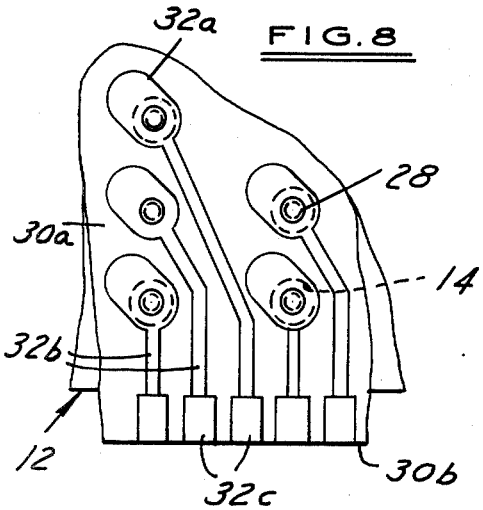

ELECTRICAL CONNECTOR

The present invention is directed to electrical connectors of a type adapted to mate with a terminal block having a plurality of terminal contact blades upstanding therefrom. More particularly, the invention is directed to a connector specifically adapted to be received over and to make electrical contact with the wire-wrap blades or terminals of a conventional telephone cable terminal block.

Objects of the present invention are to provide an electrical connector of the above-described type which is economical to assembly yet rugged in operation, which may be rapidly connected to and disconnected from a mating terminal block, and which may be received over conventional wire-wrap blades after cable conductors have been wrapped thereon.

The invention, together with additional objects, features and advantages thereof, will be best understood from the following description, the appended claims and the accompanying drawings in which:

Figure 1:
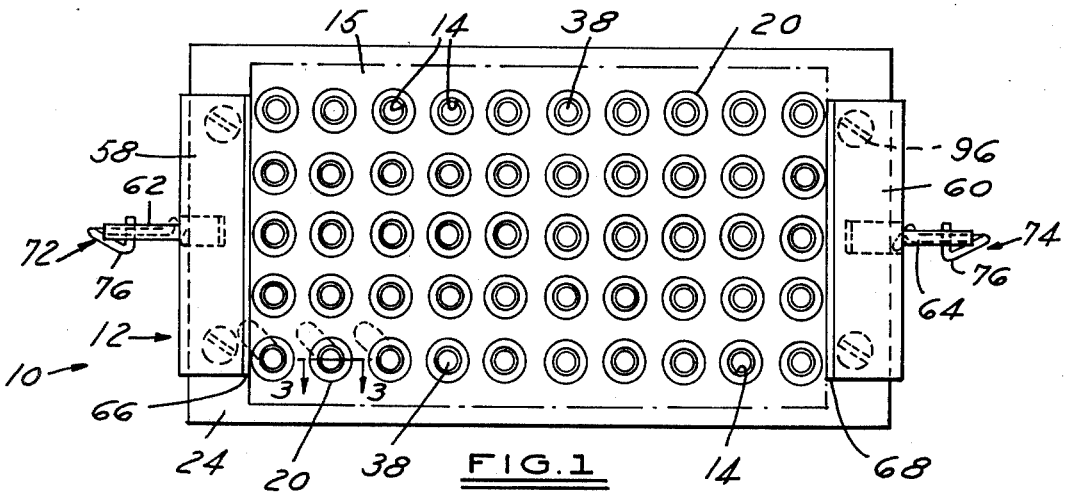
FIG. 1 is a bottom view of an electrical connector provided in accordance with the invention.
Figure 2:
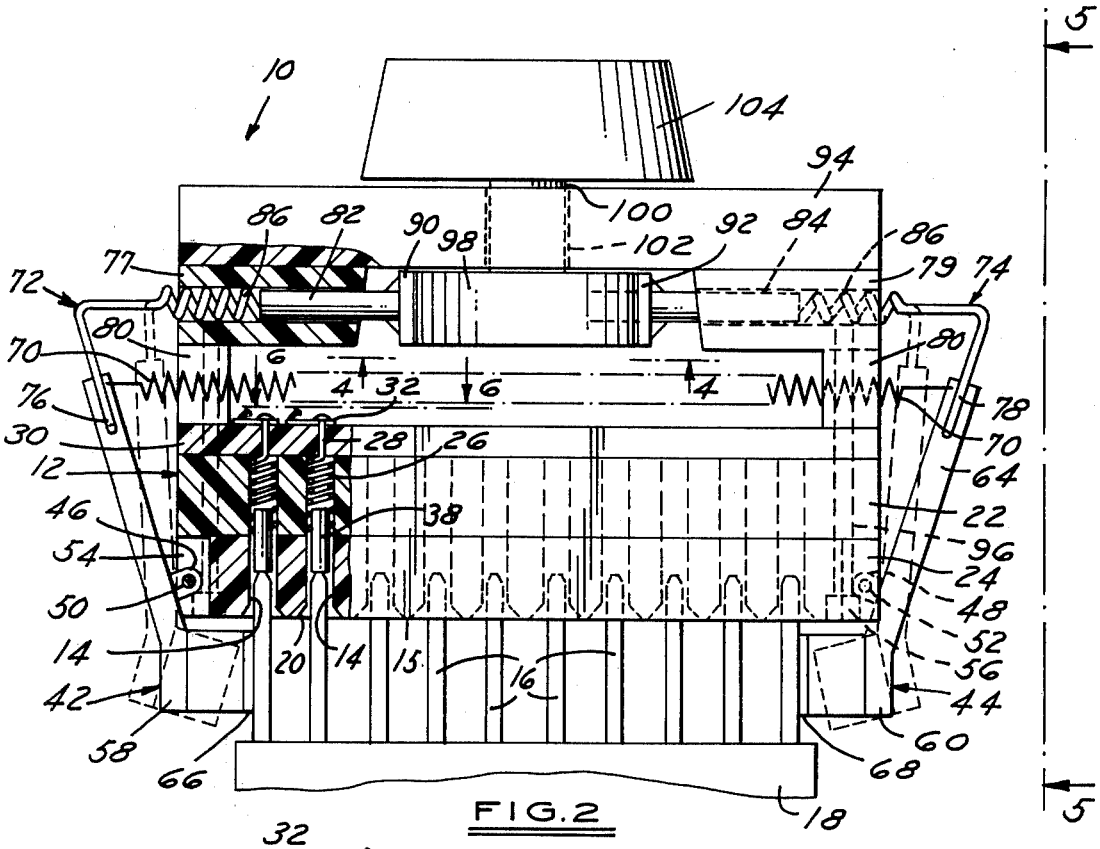
FIG. 2 is an elevational view of the connector shown in FIG. 1 mated with a conventional terminal block.
Figure 3:
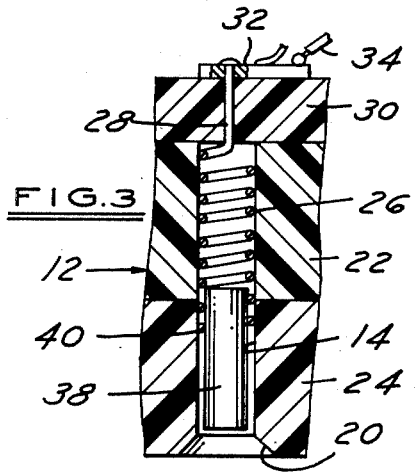
Figure 4:
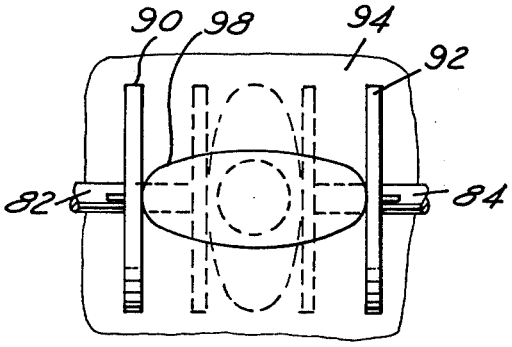

FIGS. 3 and 4 are sectional views taken along the lines 3—3 and 4—4 in respective FIGS. 1 and 2;

FIG. 5 is a side elevational view of the connector shown in FIGS. 1 and 2;

FIG. 6 is a sectional view taken along the line 6—6 in FIG. 2;

FIGS. 7 and 8 are views similar to that of FIG. 6 showing alternative embodiments of the invention; and FIG. 9 is a view similar to that of FIG. 3 illustrating yet another embodiment of the invention.

Referring to the drawings, a presently preferred embodiment 10 of the connector provided by the present invention comprises a rectangular connector body 12 of rigid molded plastic or other insulating material having a plurality of substantially cylindrical apertures 14 formed therethrough perpendicularly of one block end face 15. Apertures 14 are disposed in a suitable array adapted for individual axial registry with a corresponding plurality of terminal contact blades 16 (FIG. 2) on a conventional terminal block 18 such that body 12 may be received over blades 16 with each blade projecting into a corresponding individual one of the apertures. The ends 20 of apertures 14 opening into end face 15 are beveled radially outwardly of the aperture axes to facilitate capture of the blade ends. For convenience of manufacture and assembly, block 12 may be formed of two substantially rectangular block sections 22,24 disposed in face-to-face contact with respective segments of apertures 14 in axial alignment.

A plurality of coil springs 26 of electrically conductive material such as silver-anodized copper are disposed one in each of the apertures 14 and have elongated axially extending spring end tines 28 projecting through a board 30 of insulating material carried by connector block 12 remotely of and parallel to end face 15. End lines 28 are soldered or otherwise electrically and mechanically coupled to individual ones of a plurality of discrete conductive circuit zones 32 etched or printed onto board 30 remotely of end face 15. Conductive zones 32 are separated from each other, as shown in FIG. 6, and include first portions axially aligned with corresponding apertures 14 for connection to spring end tines 28 and second portions for electrically connecting the springs to suitable electrical circuitry. In FIG. 6, a plurality of cable conductors 34 are illustrated as being connected to respective corresponding conductive zones 32. In the alternative configuration of FIG. 7, a plurality of electrical components, specifically diodes 36, are connected between corresponding pairs of conductive zones 32. Other types of electrical circuitry may be connected to, between or among zones 32, such electrical circuitry not per se forming part of the present invention.

A plurality of cylindrical contact slugs 38 of conductive material such as copper are axially press fitted into the end coils 40 of individual corresponding springs 26 remotely of end tines 28, and are thereby resiliently suspended by the respective springs one in each of the apertures 14. When connector block 12 is received over blades 16 as illustrated in FIG. 2, springs 26 are compressed to urge contact slugs 38 into firm spring-biased electrical and mechanical engagement with the tips of corresponding blades 16. The respective blades 16 are thereby individually electrically connected through slugs 38 and springs 26 to corresponding conductive zones 32 on printed circuit board 30.

To hold connector block 12 over blades 16 against the collective force of springs 26, a pair of clamps 42,44 are pivotally mounted at opposite side edges of block 12 adjacent end face 15 by having integral clamp ears 46,48 received outer the respective pivot pins 50,52 bridging the recesses 54,56 on opposite side edges of lower block section 24. Clamps 42,44 include respective clamp head portions 58,60 adapted to embrace terminal block 18 and respective clamp leg portions 62,64 extending away from head portions 58,60 remotely of block end face 15. Specifically, head portions 58,60 are disposed generally benath end face 15 and adapted to engage laterally opposite outside rows of blades 16, and include respective surfaces 66,68 of insulating material electrically to isolate the engaged blades from each other. A coil spring 70 (FIG. 2) is connected in tension between the ends of clamp leg portions 62,64 remote from head portions 58,60 and normally resilently biases the clamps such that the heads are in a retracted pivotal position illustrated in phantom in FIG. 2. Spring 70 is spaced outwardly from and generally parallel to circuit board 30.

A pair of link members 72,74 are each hooked at one end 76,78 through a corresponding aperture in respective clamp leg portions 62,64, and project angularly outwardly and then laterally inwardly therefrom through the apertured block sections 77,79. Sections 77,79 are carried above circuit board 30 by spacer elements 80 disposed one at each corner of the rectangular circuit board. The laterally opposed inner portions 82,84 of links 72,74 include coiled link segments 86,88 for absorbing bending stresses on the clamp and link members resulting from embracement of terminal block 18, and terminate inwardly in the opposed laterally planar sections 90,92 best seen in FIGS. 2 and 4. A generally rectangular bridging block section 94 is carried by block sections 77,79 outwardly of circuit board 30. Connector block 12, including block sections 22,24, circuit board 30, spacers 80 and block sections 77,79,94 are carried in stacked relation by the screws 96 (FIG. 1 and 2) disposed adjacent the connector edge corners and projecting upwardly through the stacked block sections and spacer elements in the order previously set forth.

An elliptical cam 98 is disposed between opposed planar link segments 90,92 and is adapted to rotate in a plane parallel to the axes of clamp pivot pins 50,52, follower sections 90,92 being held against the lateral surface of cam 98 by coil spring 70. Cam 98 is connected by a shaft 100 projecting through a central aperture 102 in block section 94 to a knurled knob 104 for manually rotating the cam. Knob 104 is preferably substantially elliptical in contour when viewed from the axial direction in correspondence with the elliptical contour of cam member 98. In the cam position illustrated in phantom in FIG. 4, the link members 72,74 and the corresponding clamps 42,44 are pivoted inwardly by the force of spring 70, such that the clamp heads are in the retracted positions illustrated in phantom in FIGS. 2 and 4. As the handle and cam are rotated ninety degrees to the position indicated in solid lines in FIG. 4 wherein the cam edge sections aligned with the cam elliptical foci engage the link follower planes 90,92, the clamps and clamp heads are pivoted to the embracing position indicated in solid lines in FIG. 2. As noted above, excessive bending stresses on the clamps and link elements are absorbed by the coiled link segments 86,88.

FIG. 8 illustrated a modification to the aforedescribed basic embodiment of the invention wherein an edge **30*b* of a modified circuit board 30*a* projects laterally outwardly of a side edge of connector block 12, and wherein the conductive zones 32*a* are connected by suitably etched conductors 32*b* to an array of connection zones 32*c* disposed along circuit board edge 30*b* and adapted for mating connection with a suitable female edge-type connector (not shown). FIG. 9 illustrates a further modified embodiment of the invention. In FIG. 9 the connector block element 24*a* is formed as a one-piece unit and has countersunk or stepped apertures 14*a* a molded or drilled therein. A ledge 14*b* in aperture 14*a* is directed oppositely of connector face 15 and cooperates with a radially projecting shoulder 38*b* on the modified and otherwise substantially cylindrical slug 38*a* to retain the slug within the aperture against the outward force of spring 26. Spring 26 is not mechanically coupled to slug 38*a* other than by residual compressive spring forces. Circuit board 30*c* is illustrated as a double-sided board having end tine 28** soldered thereto at two places for added strength.

In the foregoing description and the following claims, positional or directional adjectives such as "upward", "downward", "inner", etc. are employed by way of description and not by way of limitation with respect to the orientation of the presently preferred embodiment of the invention illustrated in FIGS. 2, 3 and 5 of the drawings, it being understood that the connector may be reoriented in operation without altering the functional interrelationship of the elements as described and claimed.

The invention claimed is:

1. In an electrical connector adapted to mate with a terminal block of the type having a plurality of terminal contact blades upstanding therefrom and including a connector body adapted to be received over a said plurality of blades and means for making electrical contact with the contact blades, improved means for clamping said connector to a said terminal block comprising a pair of clamp members pivotally carried on opposite sides of said body, said clamp members having respective clamp heads adapted to embrace a said terminal block and clamp legs extending from said heads, a coil spring extending between said clamp members and normally resiliently biasing said clamp members such that said heads are in a retracted position, cam means carried centrally of said body in operative engagement with said clamp legs on a side of said body remote from the terminal block, and means for manually selectively rotating said cam means to pivot said clamp numbers including said heads from said retracted position to a position embracing a said terminal block, said clamp legs including respective leg portions extending in opposed lateral directions and being biased by said coil spring into operative engagement with said cam means.

2. The electrical connector set forth in claim 1 wherein said cam means comprises an elliptical cam member adapted to rotate in a plane parallel to the pivotal axes of said clamp members, and wherein said clamp leg portions include opposed follower surfaces engaging said cam member.

3. The electrical connector set forth in claim 2 wherein said clamp legs include portions adapted to absorb bending stresses on said clamps resulting from embracement of a terminal block.

4. The electrical connector set forth in claim 1 wherein said connector body includes a plurality of apertures adapted for registry with a said plurality of terminal contact blades such that said body may be received over the blades with the blades projecting into individual ones of said apertures, and wherein said means for making electrical contact with the contact blades comprises circuit board means carried by said body having on one side thereof remote from said body a plurality of discrete conductive zones disposed axially of corresponding ones of said apertures in said body, a plurality of coil springs disposed one in each of said apertures and having a spring end extending through said circuit board means into electrical contact with a corresponding one of said zones, and a plurality of contact means disposed one in each of said apertures and adapted to make electrical contact with corresponding ones of the blades when said body is received over the blades, said springs being compressed by blades projecting into said apertures to hold said contact means in electrical engagement with the blades and providing electrically conductive paths between said contact means and said conductive means.

5. The electrical connector set forth in claim 4 wherein said clamp heads are adapted to embrace said contact blades and respectively include insulation means adapted to engage said blades from opposite lateral directions such that said blades remain electrically isolated from each other.

6. The electrical connector set forth in claim 4 wherein said conductive zones further include means for electrically connecting said contact means with electrical circuitry.

7. The electrical connector set forth in claim 6 wherein said electrically connecting means comprises an edge portion of said circuit board means projecting from said body and adapted for mating engagement with an edge-type electrical connector.

8. The electrical connector set forth in claim 4 wherein said plurality of contact means are suspended by corresponding ones of said springs in said apertures.

9. The electrical connector set forth in claim 8 wherein said plurality of contact means comprises a plurality of substantially cylindrical contact slugs press fitted into the coils of individual ones of said coil springs.

10. The electrical connector set forth in claim 4 wherein said plurality of contact means comprises a plurality of contact slugs each having a shoulder portion projecting radially therefrom, and wherein each of said plurality of apertures includes a ledge portion for engaging a corresponding said shoulder portion and retaining said slugs in said apertures.

11. The electrical connector set forth in claim 4 wherein ends of said apertures adapted to be received over the blades are beveled radially outwardly to facilitate capture of the blades.

12. An electrical connector adapted to mate with a terminal block of the type having a plurality of terminal contact blades upstanding therefrom and including a connector body with a plurality of apertures adapted for registry with a said plurality of terminal contact blades such that said body may be received over the blades with the blades projecting into individual ones of said apertures; means for making electrical contact with the contact blades including circuit board means carried by said body having on one side thereof remote from said body a plurality of discrete conductive zones disposed axially of corresponding ones of said apertures in said body, a plurality of coil springs disposed one in each of said apertures and having a spring end extending through said circuit board means into electrical contact with a corresponding one of said zones and a plurality of contact means disposed one in each of said apertures and adapted to make electrical contact with corresponding ones of the blades when said body is received over the blades, said springs being compressed by blades projecting into said apertures to hold said contact means in electrical engagement with the blades and providing electrically conductive paths between said contact means and said conductive means; and improved means for clamping said connector to a said terminal block comprising a pair of clamp members pivotally carried by said body, said clamp members having respective clamp heads adapted to embrace a said terminal block and clamp legs extending from said heads, a coil spring extending between said clamp members and normally resiliently biasing said clamp members such that said heads are in a retracted position, cam means carried by said body in operative engagement with said clamp legs, and means for manually selectively rotating said cam means to pivot said clamp numbers including said heads from said retracted position to a position embracing a said terminal block, said clamp heads being adapted to embrace said contact blades and respectively including insulation means adapted to engage said blades from opposite lateral directions such that said blades remain electrically isolated from each other.

* * * * *